US010925386B2

(12) United States Patent
Stango

(10) Patent No.: US 10,925,386 B2
(45) Date of Patent: Feb. 23, 2021

(54) INERTIA-ACTIVATED PULLEY MOTION AND SPEED AMPLIFICATION OF BRISTLE BELTED ROTARY POWER TOOL

(71) Applicant: Marquette University, Milwaukee, WI (US)

(72) Inventor: Robert J. Stango, Milwaukee, WI (US)

(73) Assignee: Marquette University, Milwaukee, WI (US)

( * ) Notice: Subject to any disclaimer, the term of this patent is extended or adjusted under 35 U.S.C. 154(b) by 241 days.

(21) Appl. No.: 16/027,718

(22) Filed: Jul. 5, 2018

(65) Prior Publication Data

US 2019/0008269 A1 Jan. 10, 2019

Related U.S. Application Data

(60) Provisional application No. 62/528,625, filed on Jul. 5, 2017.

(51) Int. Cl.
*A46B 13/02* (2006.01)
*B24B 29/00* (2006.01)
(Continued)

(52) U.S. Cl.
CPC ..... *A46B 13/02* (2013.01); *A46B 13/001* (2013.01); *B24B 29/005* (2013.01);
(Continued)

(58) Field of Classification Search
CPC ..... A46B 13/02; A46B 13/13001; A46B 2200/3093; B24B 29/005; B24B 21/12; B24B 23/06; B24D 13/10; B05D 3/12
See application file for complete search history.

(56) References Cited

U.S. PATENT DOCUMENTS 1,171,962 A * 2/1916 Kinan ..... A46B 13/001 15/198
1,920,364 A * 8/1933 Degen ..... B24B 23/06 451/355
(Continued)

FOREIGN PATENT DOCUMENTS

EP 1834733 A1 9/2007
JP 2006130641 A 5/2006
(Continued)

OTHER PUBLICATIONS

International Search Report and Written Opinion for PCT/US2018/040876, dated Oct. 18, 2018.

*Primary Examiner* — Weilun Lo
(74) *Attorney, Agent, or Firm* — Andrus Intellectual Property Law, LLP

(57) ABSTRACT

A device for processing a surface of a work piece. A motor is configured to produce a rotary force. A driving pulley is operatively coupled to the motor such that the rotary force produced by the motor causes rotation of the driving pulley. A belt is operatively coupled to the driving pulley such that rotation of the driving pulley causes rotation of the belt. A second pulley is also operatively coupled to the belt such that rotation of the belt causes rotation of the second pulley. Bristles are coupled to the belt and extend away from the belt. The rotary force produced by the motor causes the plurality of bristles to move relative to the motor. The surface of the work piece is processed when the bristles contacts the surface while the bristles are moving.

20 Claims, 12 Drawing Sheets

(51) Int. Cl.

| | |
|---|---|
| ***A46B 13/00*** | (2006.01) |
| *B24D 13/10* | (2006.01) |
| *B05D 3/12* | (2006.01) |

(52) U.S. Cl.
CPC ..... *A46B 2200/3093* (2013.01); *B05D 3/12* (2013.01); *B24D 13/10* (2013.01)

(56) References Cited

U.S. PATENT DOCUMENTS

| | | | | | |
|---|---|---|---|---|---|
| 2,576,745 | A * | 11/1951 | Auten | B24B 23/06 | 451/355 |
| 3,611,646 | A * | 10/1971 | Cameron et al. | B24B 21/00 | 451/355 |
| 3,713,255 | A * | 1/1973 | Welsch | B24B 23/06 | 451/355 |
| 6,425,811 | B1 | 7/2002 | Marks, Jr. | | |
| 8,961,272 | B2 | 2/2015 | Timcke et al. | | |
| 2007/0209126 | A1* | 9/2007 | Montabaur | A46B 13/001 | 15/21.1 |
| 2016/0165842 | A1* | 6/2016 | De Koning-Trunn | A46B 13/02 | 119/601 |

FOREIGN PATENT DOCUMENTS

| | | | |
|---|---|---|---|
| RU | 130899 | U1 | 8/2013 |
| RU | 143707 | U1 | 7/2014 |
| SU | 599331 | A1 | 3/1978 |

* cited by examiner

INERTIA-ACTIVATED PULLEY MOTION AND SPEED AMPLIFICATION OF BRISTLE BELTED ROTARY POWER TOOL

CROSS REFERENCE TO RELATED APPLICATION

This application claims the benefit of U.S. Provisional Patent Application No. 62/528,625, filed Jul. 5, 2017, which is incorporated herein by reference in its entirety.

FIELD

The present disclosure generally relates to bristle belted rotary power tools, and more particularly to inertia-activated bristle belted rotary power tools having improved performance.

BACKGROUND

The Background and Summary are provided to introduce a foundation and selection of concepts that are further described below in the Detailed Description. The Background and Summary are not intended to identify key or essential features of the potentially claimed subject matter, nor are they intended to be used as an aid in limiting the scope of the potentially claimed subject matter.

The construction of a typical continuous bristle belt is shown in FIG. 1A, which consists of a flexible belt 50 having a plurality of bristles 60 that are formed, shaped, or otherwise fastened along the belt 50 length. The bristles 60 have a length 66 that extends between an anchor end 62 that is coupled to the belt 50, and a bristle tip 64. The bristle tips 64 are often forward bent and sharpened. Certain power brushing tools are fabricated by wrapping qthe belt 50 around a shaft 36 as shown in FIG. 1B, or by fitting a closed loop belt 50 around a circular hub 38, as shown in FIGS. 2A-2C.

Subsequently, the shaft 36 or hub 38 is rotated in the rotation direction R, and the working surface of the belt 50 (that is, the bristle tips 64 of bristles 60) is directly applied to a target surface 4 of the work piece 2, as shown in FIG. 3. Typically, these existing devices 6 are used for cleaning, texturing, or otherwise modifying surfaces, and may include, for example, scale removal, surface preconditioning, work hardening, and/or aesthetic value.

The particular geometric configuration and composition of these existing devices 6 is a direct consequence of the individual material constituents, namely, the bristle 60 shape, geometry, and composition, as well as the composition of the belt 50 materials to which the bristles 60 are attached. These fixed choices for tool composition, in concert with the speed of rotation and force and penetration exerted onto the work piece surface, ultimately characterize the performance of the rotary tool during operation.

One particular device has been developed to improve the performance of bristle belted rotary tools by altering the dynamic behavior of bristles 60 during rotation. Specifically, the device disclosed in Patent Application EP1834733 involves the use of an obstruction, or "stop element" 7, that when placed in the path of oncoming bristles 60 causes a temporary retraction or dwell of the bristle tips 64 (see FIG. 4). Upon release from the stop element 7, the bristle tips 64 rapidly move forward, striking the work piece 2 with increased speed. This is said to enhance the impact force that is generated by the device during operation. The cleanliness and surface texture that is generated by this device is said to rival the surface quality that is generated by environmentally-challenged grit blasting processes.

SUMMARY

One embodiment of the present disclosure generally relates to a device for processing a surface of a work piece. The device includes a motor configured to produce a rotary force and a driving pulley operatively coupled to the motor such that the rotary force produced by the motor causes rotation of the driving pulley. A belt having an outer side and an inner side is operatively coupled along the inner side to the driving pulley such that rotation of the driving pulley causes rotation of the belt. A second pulley is also operatively coupled to the inner side of the belt such that rotation of the belt causes rotation of the second pulley. A plurality of bristles each have an anchor end and a bristle tip opposite the anchor end. Each anchor end is coupled to the belt and each bristle extends away from the belt. The rotary force produced by the motor causes the plurality of bristles to move relative to the motor. The surface of the work piece is processed when the plurality of bristles contacts the surface while the plurality of bristles is moving.

Another embodiment generally relates to a method for processing a surface of a work piece. The method includes producing a rotary force with a motor and coupling a driving pulley to the motor such that the rotary force produced by the motor rotates the driving pulley. The method includes coupling a belt to the driving pulley, where the belt has an outer side and an inner side, where the inner side is in contact with the driving pulley, and where rotating the driving pulley rotates the belt. The method includes coupling a second pulley to the belt, where the inner side is in contact with the second pulley, and where rotating the belt rotates the second pulley. The method includes coupling a plurality of bristles to the belt, where each bristle in the plurality of bristles has an anchor end and a bristle tip opposite the anchor end. Each anchor end is coupled to the outer side of the belt and each bristle in the plurality of bristles extends away from the belt. Rotating the belt causes the plurality of bristles to move relative to the motor. The surface of the work piece is processed by contacting the surface with the plurality of bristles while the plurality of bristles is moving.

Various other features, objects and advantages of the disclosure will be made apparent from the following description taken together with the drawings.

BRIEF DESCRIPTION OF THE DRAWINGS

The drawings illustrate embodiments for carrying out the disclosure. The same numbers are used throughout the drawings to reference like features and like components. In the drawings.

DETAILED DISCLOSURE

This written description uses examples to disclose embodiments of the present application, including the best mode, and also to enable any person skilled in the art to practice or make and use the same. The patentable scope of the invention is defined by the potential claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The present disclosure describes the device and function of a unique power tool that utilizes the dynamic properties of existing bristle belt technology. It provides an alternative approach for accelerating wire bristle tips that would not require the placement/collision of an obstacle in the direct path of rotary bristle motion.

Figure 7A:
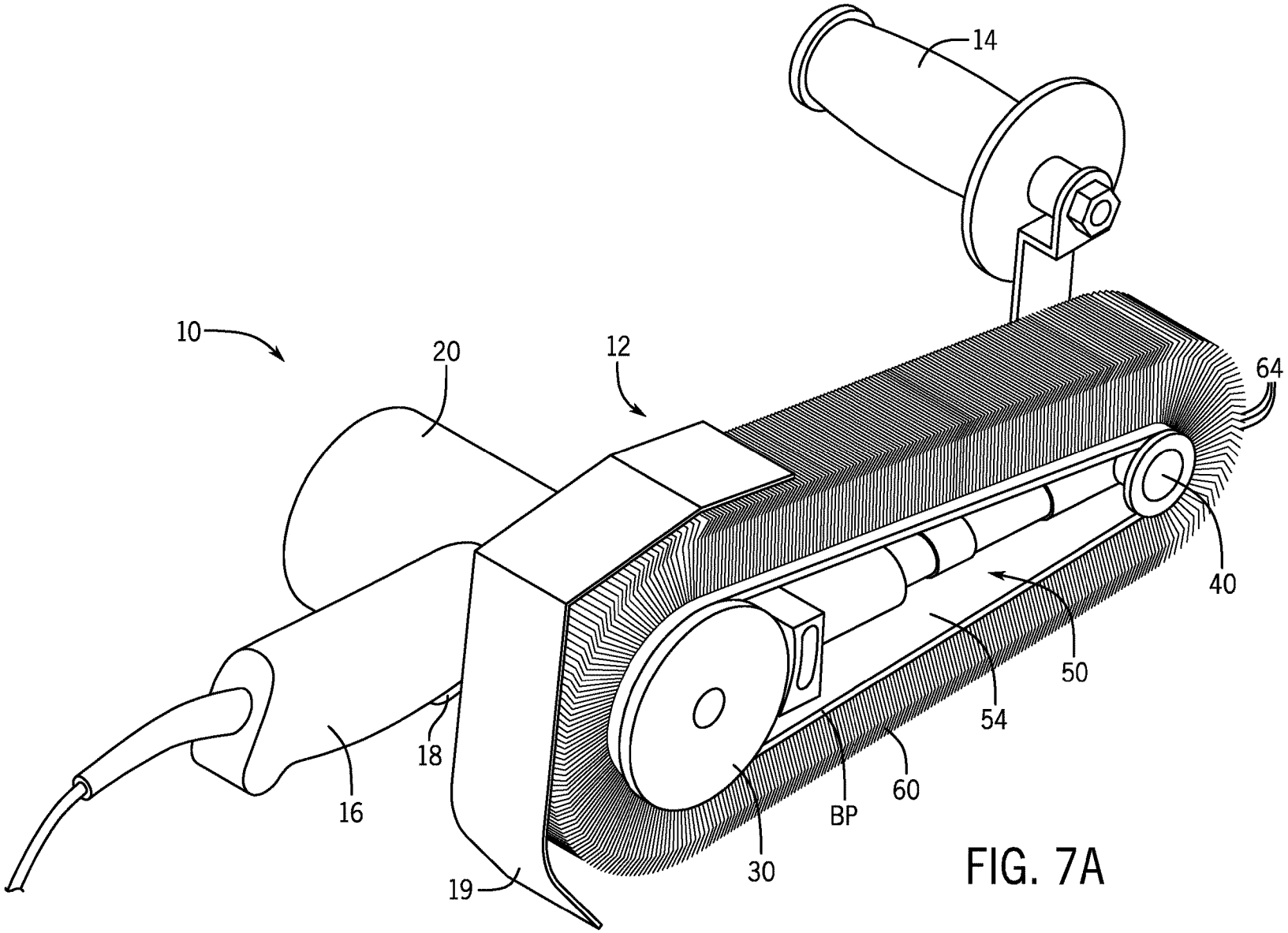
FIGS. 7A-7B are isometric and side views of an exemplary device according to the present disclosure for carrying out the method depicted in FIGS. 5-6.
Figure 7B:
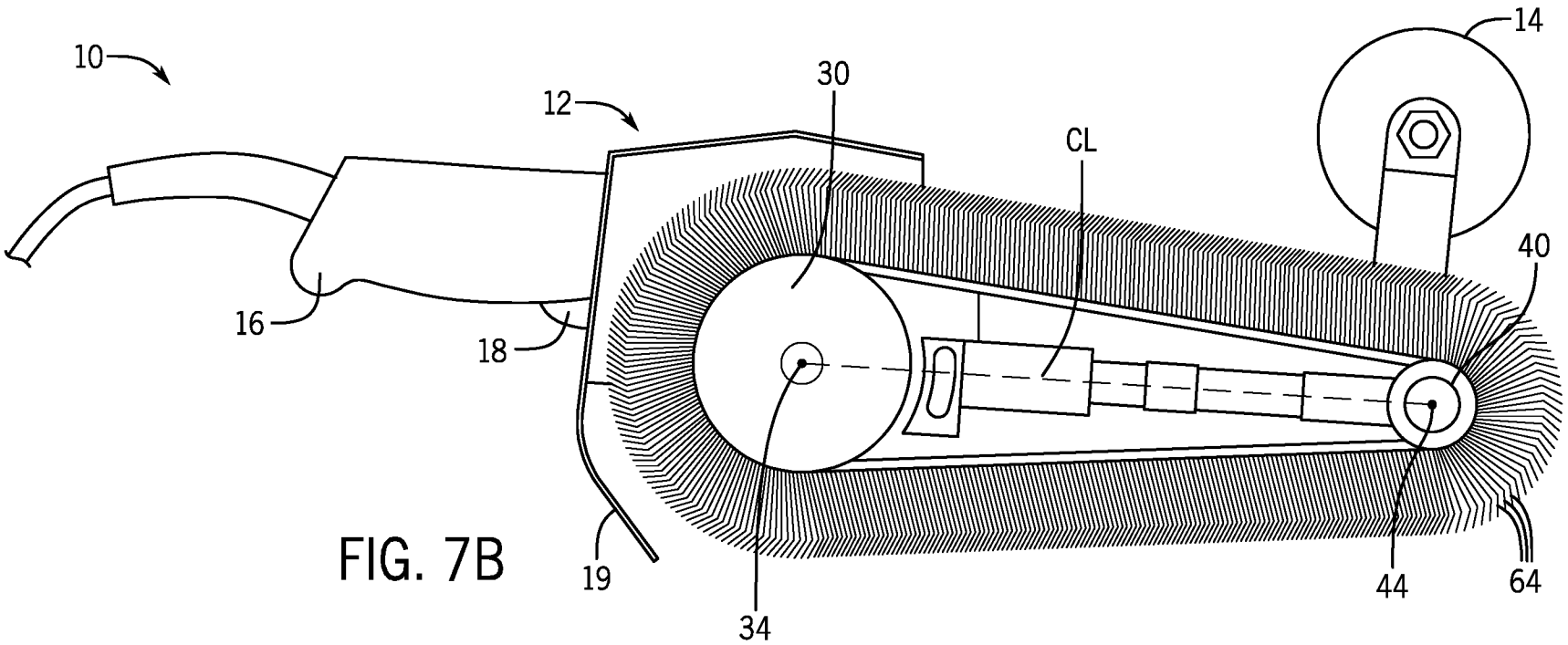

The methods and devices 10 present disclosed are best understood through a brief introduction to the exemplary embodiment provided in FIGS. 7A-7B. The device 10 includes a motor 20 configured to produce a rotary force in the rotation direction R in the same manner provided with the existing devices 6 previously discussed. The exemplary device 10 may incorporate a front handle 14 and rear handle 16, which may further incorporate a trigger 18 or other actuation device to control operation of the motor 20. In certain embodiments, a shield 19 is also provided. It should be recognized that alternate configurations for securing and actuating the device 10 are also anticipated by the present disclosure, including devices 10 integrated into robotic and/or automation systems.

However, in contrast to existing devices 6 presently known in the art and discussed above, the bristles 60 of the presently disclosed device 10 do not follow a circular belt path BP about the motor 20. Instead, a driving pulley 30 is operatively coupled to the motor 20 such that the rotary force produced by the motor 20 causes rotation of the driving pulley 30. The device 10 further includes a second pulley 40 that is distally located from the motor 20 as compared to the driving pulley 30. A belt 50, which in certain embodiments employs existing belt technology known in the art, is operatively coupled between the driving pulley 30 and the second pulley 40. The belt 50 has an outer side 52 and an inner side 54, whereby the driving pulley 30 and second pulley 40 engage the belt 50 on its inner side 54. In this manner, rotation of the belt 50 by the driving pulley 30 also causes rotation of the second pulley 40.

It should be recognized that the term "pulley" in the present disclosure should be read broadly to also include rollers and any other guiding and/or directional elements that define the belt path BP, whether rotating or stationary. Likewise, while the bristles 60 are shown in the figures to have a rectangular cross-section, all shapes of bristles 60 are anticipated by the present disclosure (including circular, for example).

A plurality of bristles 60 each have an anchor end 62 that is coupled to the belt 50, as well as a bristle tip 64 opposite the anchor end 62 that extends away from the belt 50. Consequently, the rotary force produced by the motor 20 causes the bristles 60 to move relative to the motor 20 along the non-circular belt path BP. The surface 4 of the work piece 2 is processed by placing the bristle tips 64 in contact with the surface 4 while the bristles 60 are in motion.

Figure 1A:
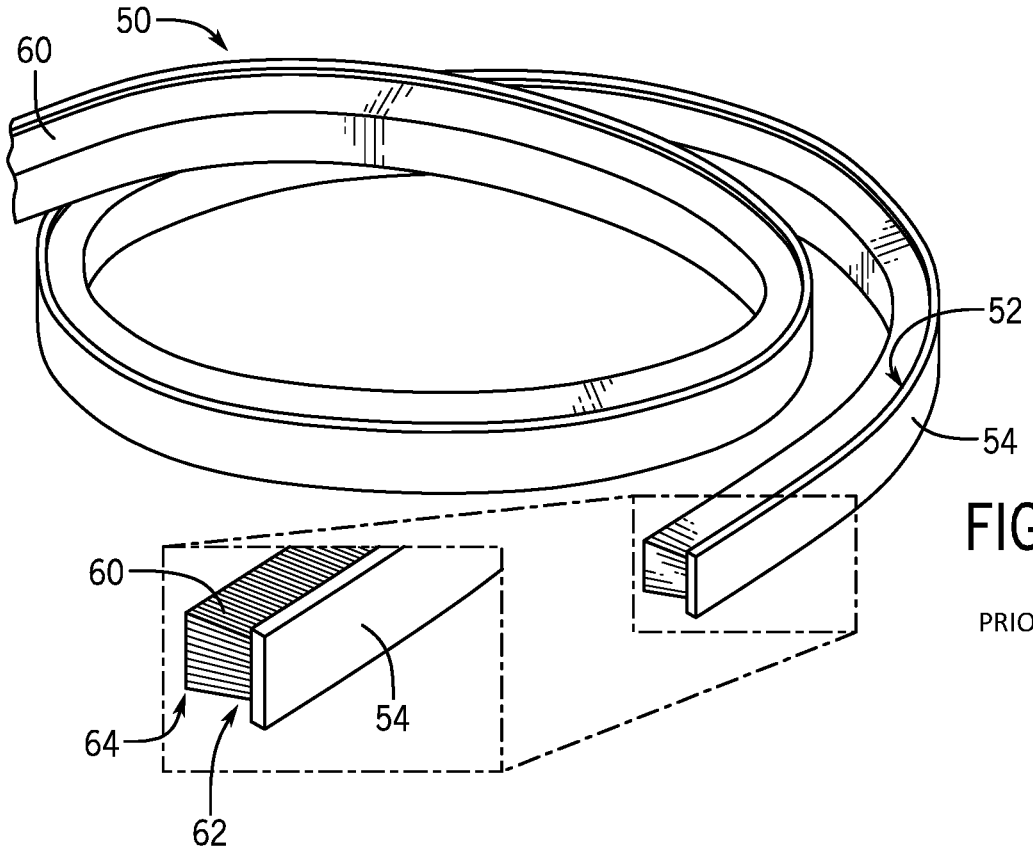
FIG. 1A PRIOR ART
FIGS. 1A-1B depict isometric views of a portion of a bristle belt, and a brush fabricated using such a bristle belt, as known in the art.
Figure 1B:
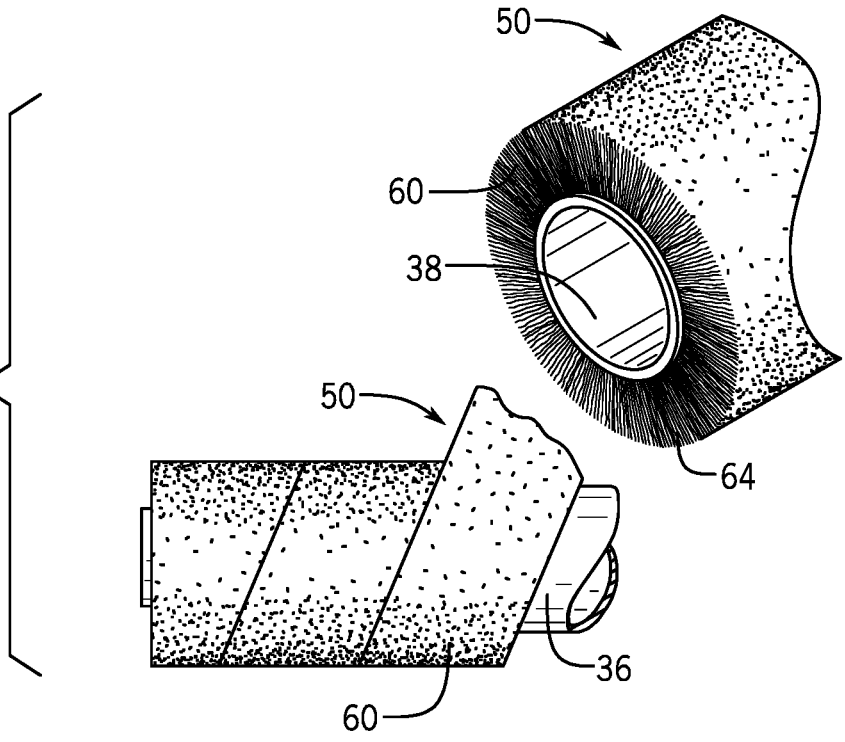
FIG. 1B PRIOR ART
Figure 2A:
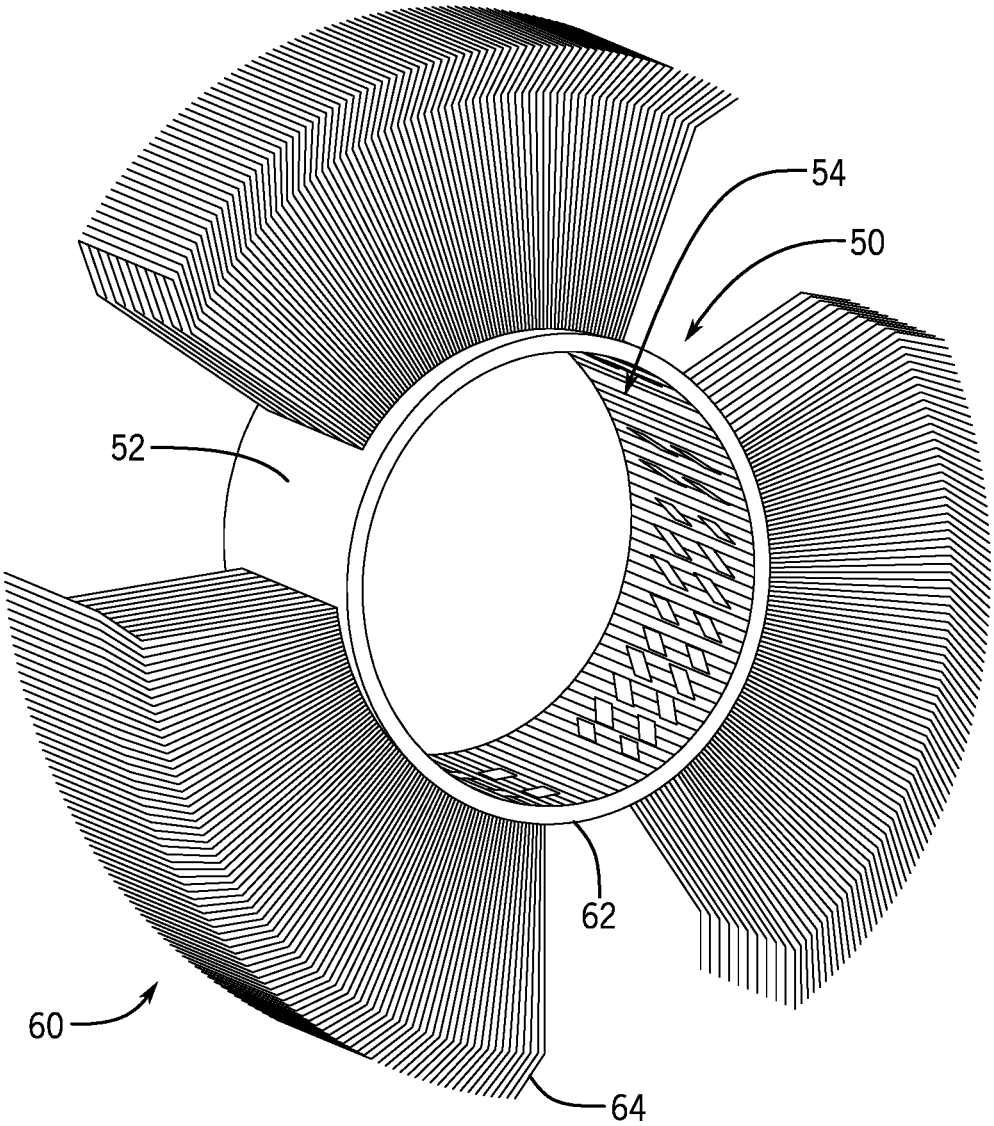
FIG. 2A PRIOR ART
FIGS. 2A-2C depict a closed-loop bristle belt and subsequent fitting to a hub, as well as a close-up of the bristle tips, as known in the art.
Figure 2B:
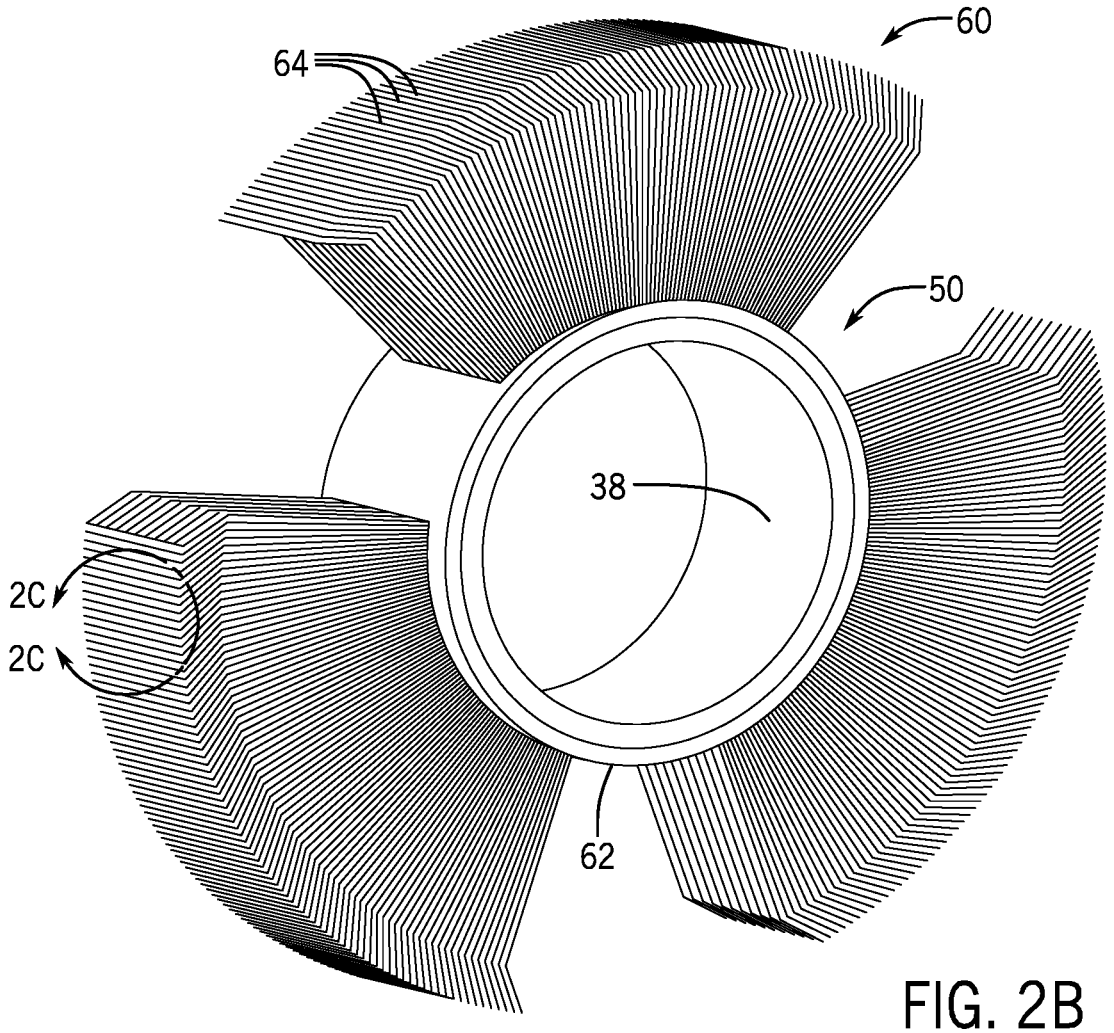
FIG. 2B PRIOR ART
Figure 2C:
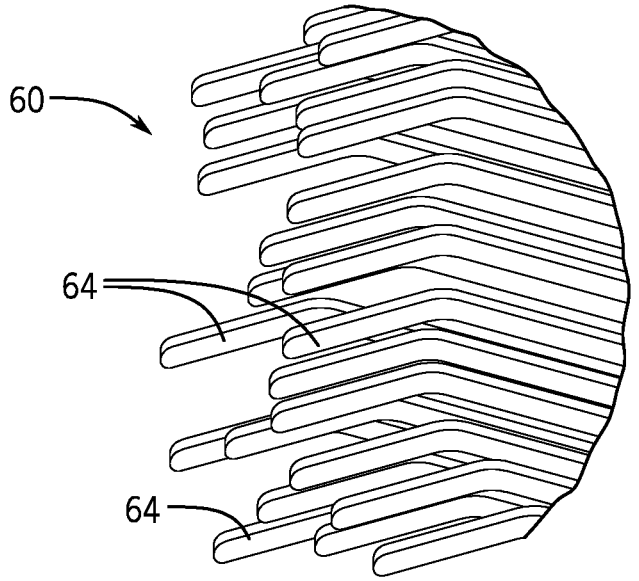
FIG. 2C PRIOR ART
Figure 3:
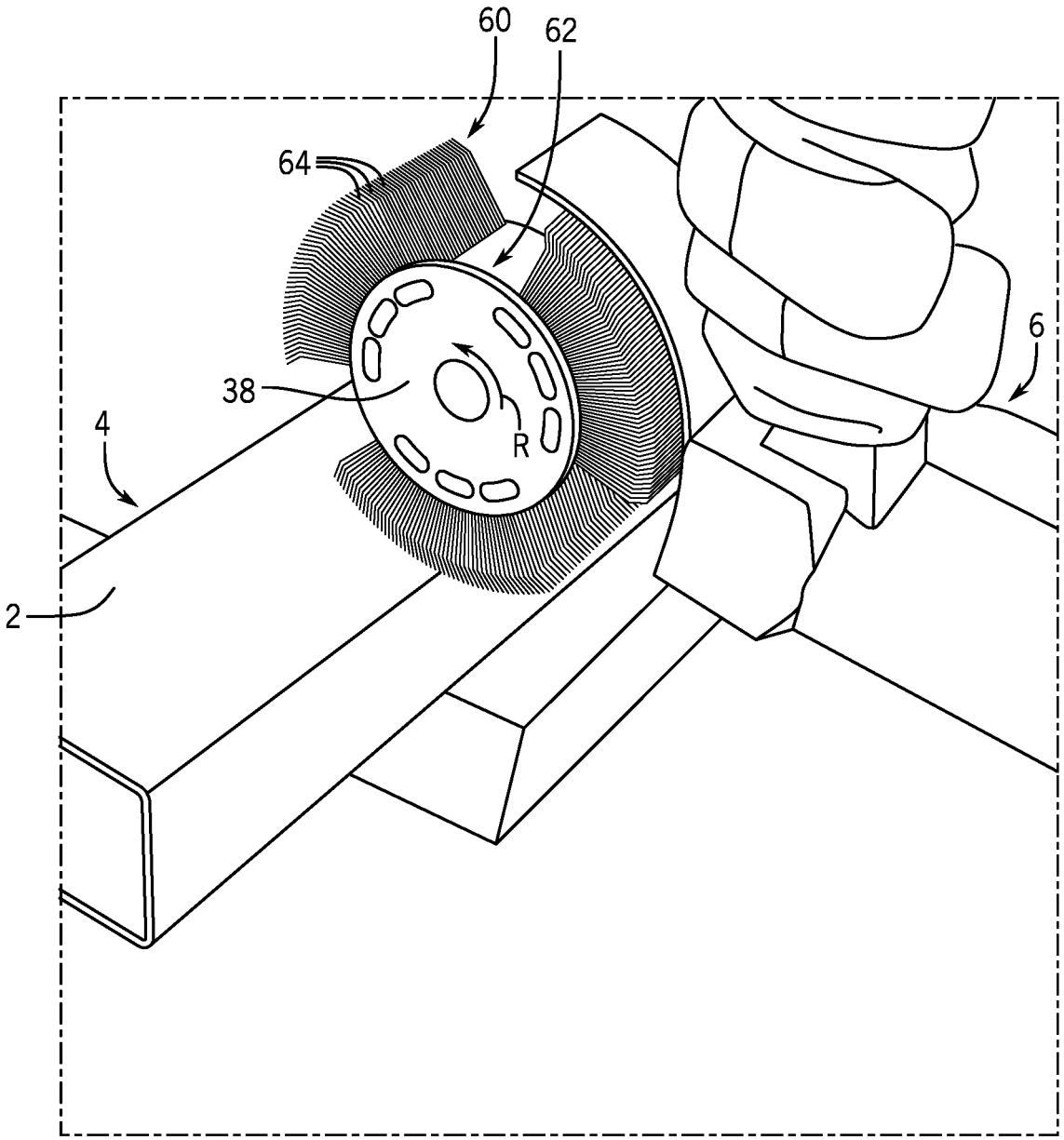
FIG. 3 PRIOR ART
FIG. 3 is an isometric view of an existing device incorporating a bristle belt such as that shown in FIG. 2B as known in the art.
Figure 4:
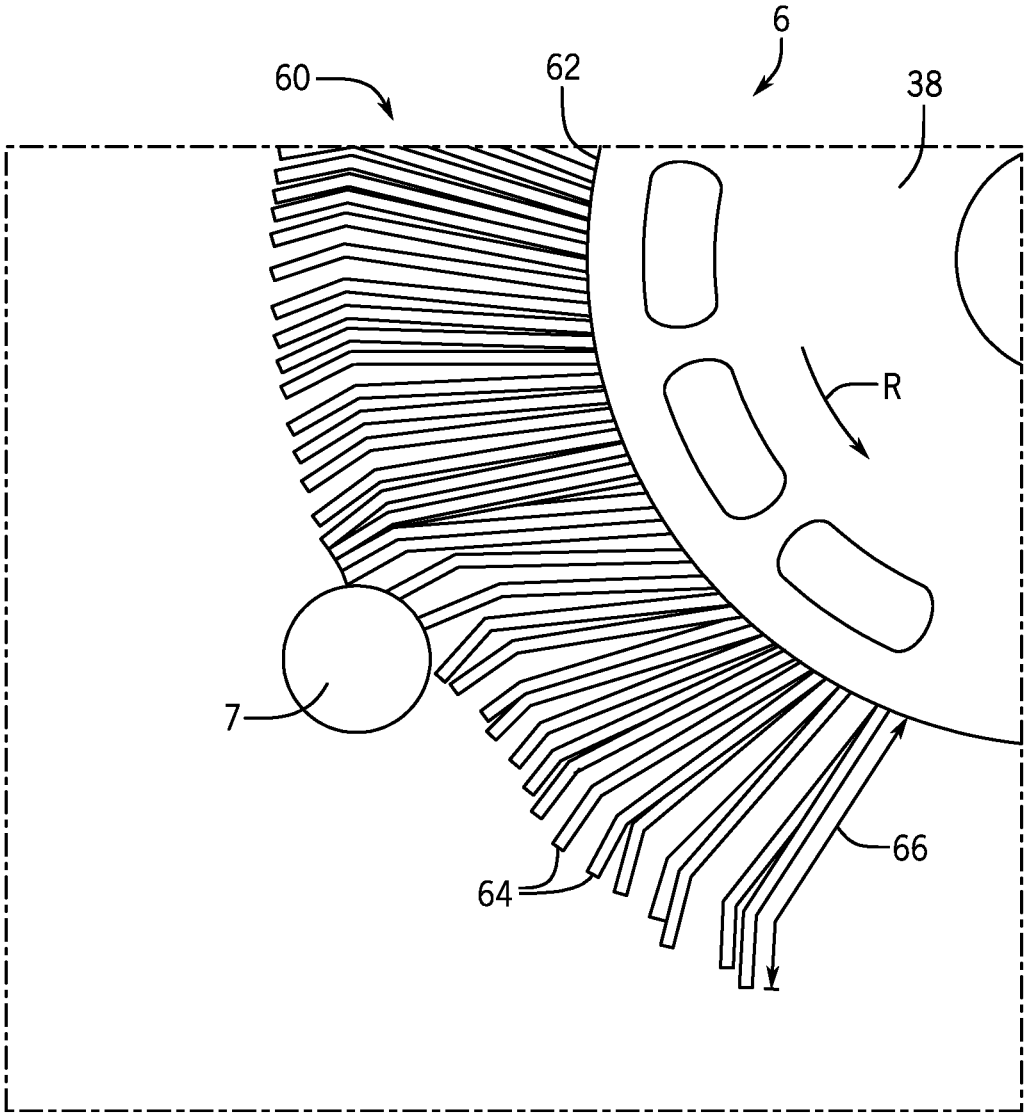
FIG. 4 PRIOR ART
FIG. 4 is a close-up, high-speed depiction of the bristle belt device disclosed in Patent Application EP 1,834,733, incorporating a stop element.
Figure 5:
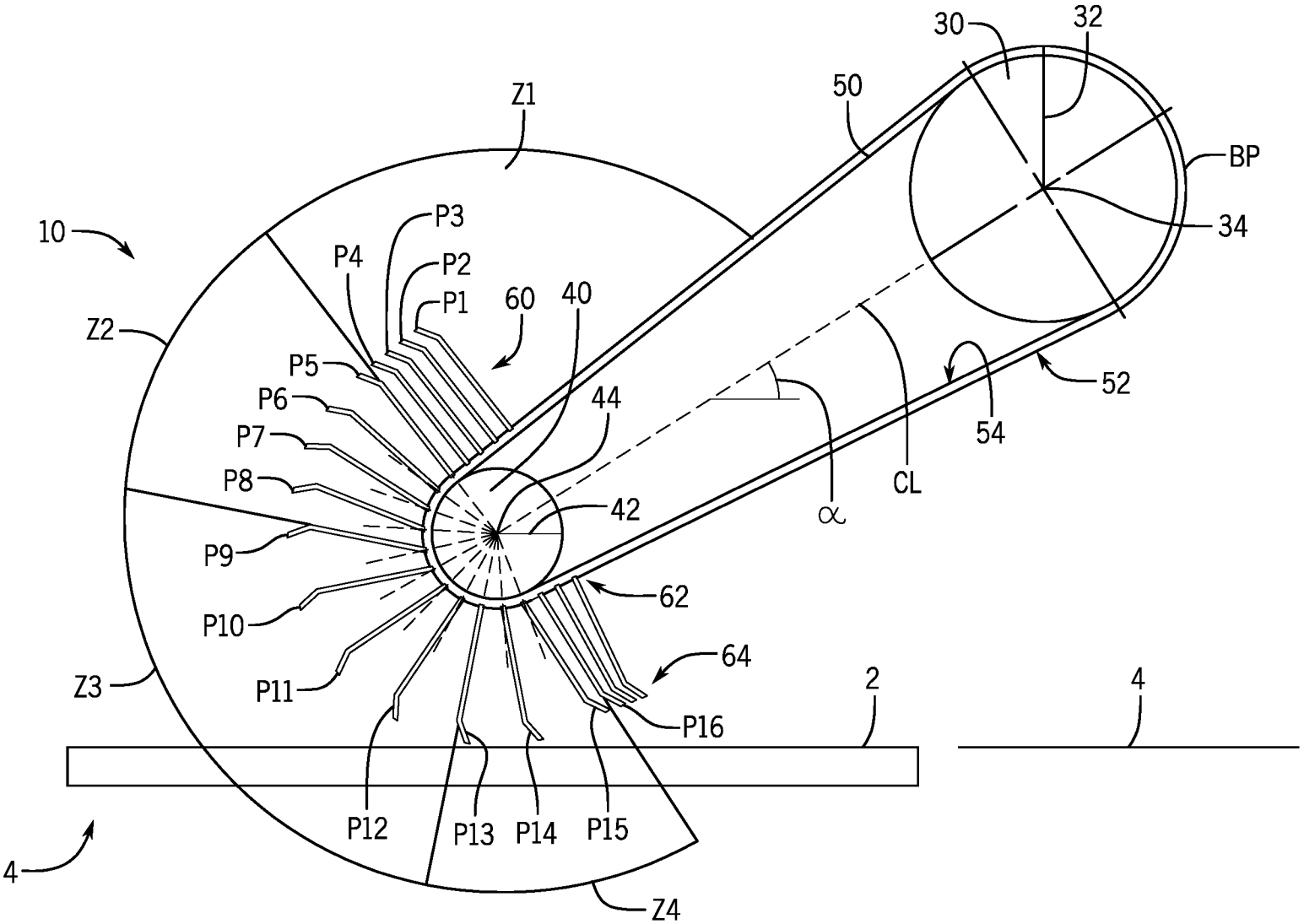
FIG. 5 is a schematic view depicting an exemplary method for processing a surface according to the present disclosure.

As will become apparent, the presently disclosed devices 10 and methods provide a novel approach for increasing the speed of bristle tips 64 prior to impact with the target surface 4. The concept and implementation of these devices 10 and methods are based upon the inertial properties of bristles 60 and centrifugal forces generated by intentionally and abruptly altering the direction of bristle 60 motion. The mechanism for altering bristle 60 motion is accomplished by using two or more pulley drive configurations for powering the bristle belt, as shown in FIG. 5. That is, motion of the bristle 60 is abruptly altered as it passes around a pulley (here, second pulley 40) having a strategically proportioned radius. For example, the smaller the second radius 42 of the second pulley 40 relative to the driving radius 32 of the driving pulley 30, the greater the speed of the bristle tip 64 in use. Detailed movement and further explanation of the bristle 60 is described as follows.

Prior to entering the region of the second pulley 40, the bristles 60 move forward in a straight line at a prescribed constant speed along the belt path BP, which is shown between positions P1-P4 and designated first zone Z1. Upon reaching position P5, the belt path BP of the belt 50 and the anchor ends 62 of the bristles 60 must now change from a straight path, to a curved path, which is prescribed by the second radius 42 of the second pulley 40.

The change in motion of the anchor ends 62 at position P5 results in a rapid retraction (that is, rearward movement) of the bristle tip 64, as shown in the second zone Z2. This reverse motion or rearward movement of the bristle tip 64 is a consequence of the inertial reaction force of the bristle 60, and continues along belt path BP from positions P6-P8, until maximum rearward movement is reached at position P9. Throughout this period of retraction, energy is stored both within the bristle 60 (due to bending) and within the belt 50 (due to torsion). Subsequently, the stored energy is released as the bristle tip 64 accelerates or "snaps" forward between positions P10-P12 (third zone Z3). In the present embodiment, the bristle tip 64 acquires maximum enhanced speed in the forward direction at position P13. Finally, the bristle tip 64 decelerates along the belt path BP at positions P14-P16 (fourth zone Z4), where the bristle tip 64 speed slows as it exits the arc of the second pulley 40.

Figure 6:
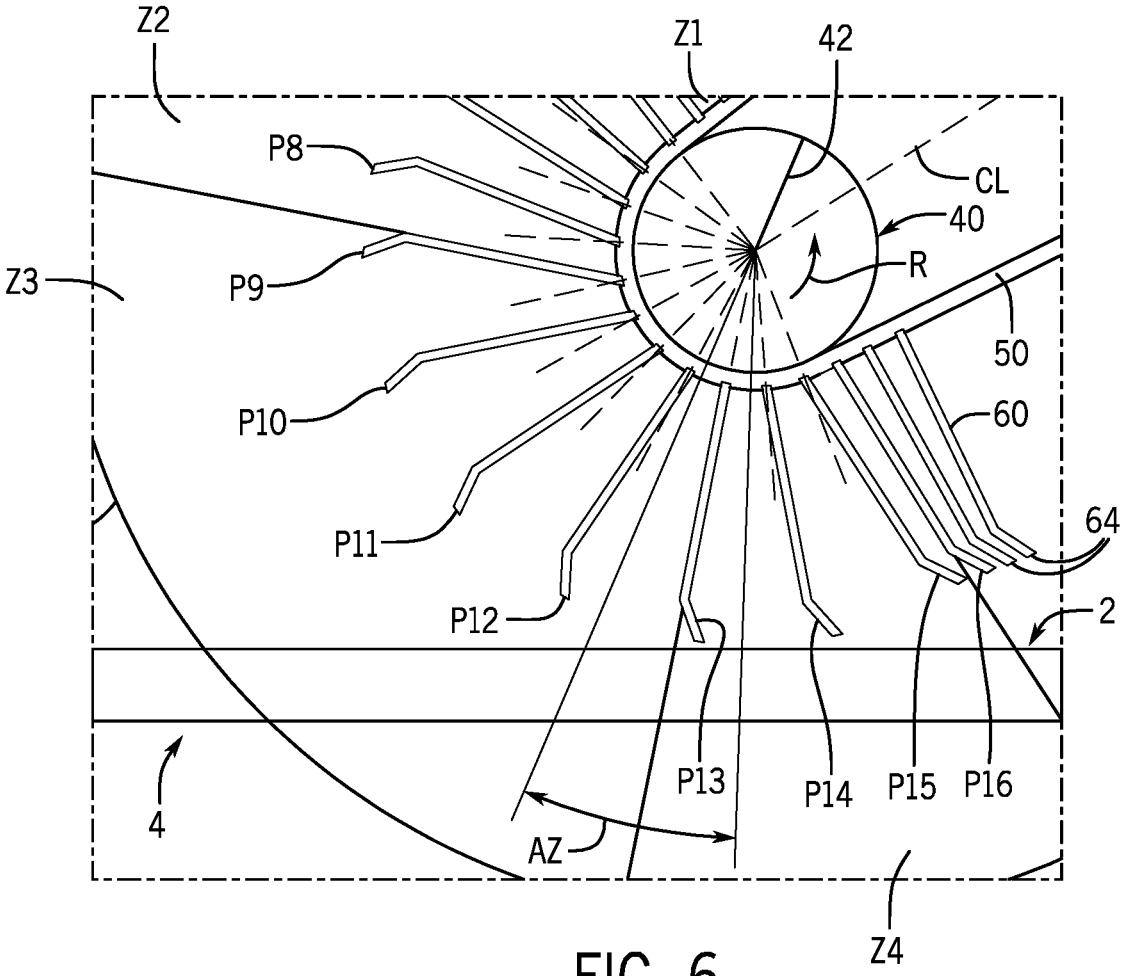
FIG. 6 is a close-up view of the activation zone for the device shown in the method depicted in FIG. 5.

In this manner, the presently disclosed device 10 and method utilize the above describe the cyclic and dynamic process of bristle 60 inertia-activated motion. As stated above, the driving radius 32 and second radius 42 of the driving pulley 30 and second pulley 40, respectively, are strategically chosen so as to promote use of the bristle tips 64 as they acquire maximum enhanced speed at, or within the proximity of, position P13. Thus, the optimal configuration for positioning the device 10 during use is demonstrated in FIG. 6, whereby maximum bristle tip 64 speed is acquired within an activation zone AZ. Through experimentation and development, the present inventor has determined that in many embodiments the activation zone AZ varies between 10 degrees and 30 degrees, depending on the materials, dimensions, and shapes of the belt 50 and bristles 60, rotational speed, the second radius 42 of the second pulley 40, and other factors. In the exemplary embodiment shown in FIG. 6, the bristles 60 contact the surface 2 within the activation zone AZ when the angle α between the center line CL and the surface 2 is typically less than 45 degrees. However, it should be recognized that the present disclosure is not limited to any particular range of angle α between the center line CL and surface 2.

It should be recognized that although the surface 4 may also be parallel to the horizontal plane H, the optimal position or activation zone AZ is based on the angle α between the surface 2 and a center line CL defined between the axes 34, 44 of the driving pulley 30 and second pulley 40, respectively. This activation zone AZ constitutes the region of bristle 60 contact in which the bristle tips 64 have maximum speed. Therefore, this activation zone AZ constitutes the range in which the bristle tips 64 engage with the target surface 4 to yield optimal performance and, consequently, optimal implementation of the disclosed devices 10 and methods.

In certain embodiments, the present inventor has identified that optimal performance occurs when the device 10, and more specifically the center line CL extending between the axes 34, 44 of the driving pulley 30 and the second pulley 40, is between 10 degrees and 30 degrees relative to the surface 4. An optimal range for positioning the device 10 may also be defined as a predetermined angle range, which is based on the driving radius 32 and/or second radius 42. In certain embodiments, the predetermined angle range spans from a minimum angle and a maximum angle with an ideal angle defined therebetween.

Figure 8:
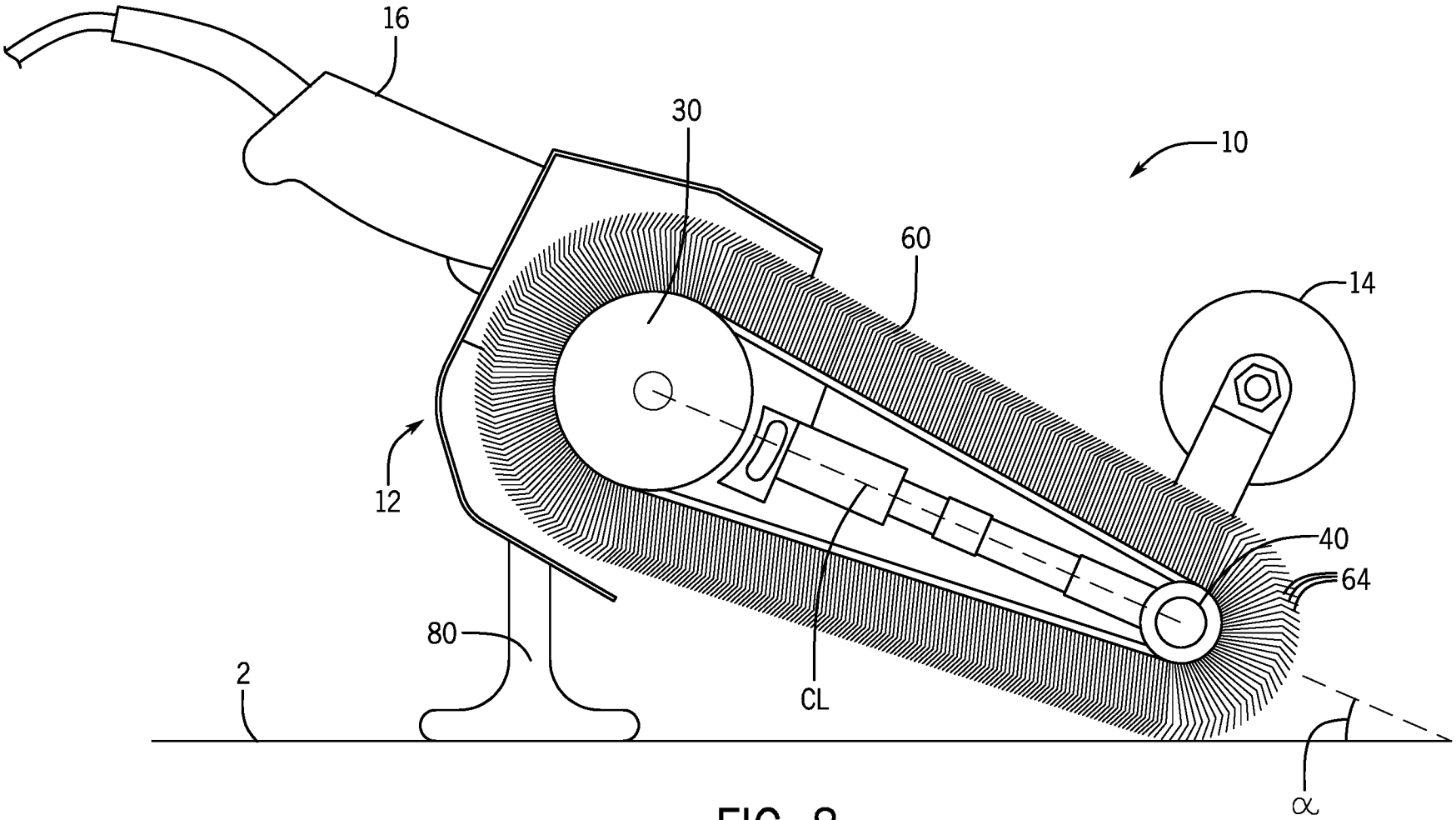

Accordingly, further embodiments according to the present disclosure assist with positioning the device 10 relative to the surface 4 to obtain this optimal performance. In the exemplary embodiment shown in FIG. 8, the device 10 further incorporates a positioner foot 80 to guide the device 10 such that the center line CL is at an angle α from the surface 4. In certain embodiments, the positioner foot 80 is collapsible such that it can be stowed away when the device 10 is not in use. It should be recognized that the positioner foot 80 presently shown is merely exemplary, and have alternate forms or be coupled to the device 10 in other locations.

Figure 9:
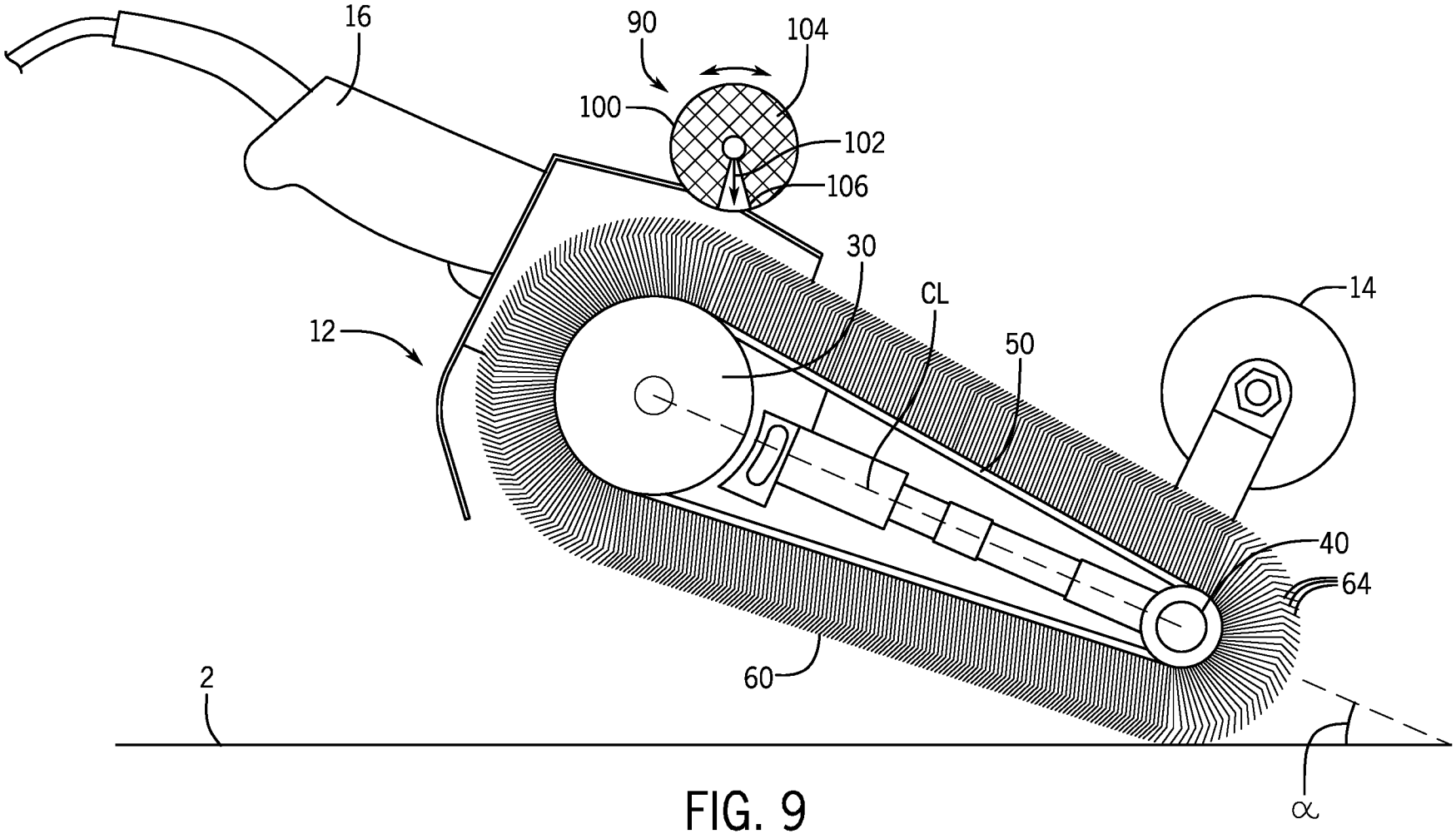

FIG. 9 shows a further embodiment of a device 10 according to the present disclosure, which optionally includes a positioner foot 80 (not shown). The embodiment of FIG. 9 includes an angle indicator 90, which rather than guiding the device 10 directly, informs the operator of the angle α between the center line CL and the horizontal plane H. It should be noted that the surface 4 of the work piece 2 may not always be parallel to the horizontal plane H. Therefore, further embodiments provide that the angle indicator 90 will accommodate for angular offsets between the surface 4 and the horizontal plane H. Once corrected, the angle indicator 90 is once again configured to indicate the angle α between the surface 4 and the center line CL of the device 10. For example, in the embodiment shown (a visual indicator 100) the reading values 104 of the angle indicator (discussed below) can be rotatable to calibrate the position of the surface 4 relative to the horizontal plane H.

As stated above, the angle indicator 90 shown in FIG. 9 is a visual indicator 100. In the embodiment shown, the visual indicator 100 includes a weighted arrow 102 that is movable by gravity among a scale or backdrop of reading values 104. In the present embodiment, the minimum angle and maximum angle of a predetermined angle range is provided within the reading values 104. The visual indicator 100 shown also incorporates guidance outputs 106, which shows when the device 10 is at an optimal angle α relative to the surface 4 by the position of the weighted arrow 102. For example, the guidance outputs 106 may include a red colored range of reading values 104 or backdrop when the weighted arrow 102 does not fall between the minimum angle and the maximum angle (and/or green when between the minimum angle and maximum angle).

Figure 10:
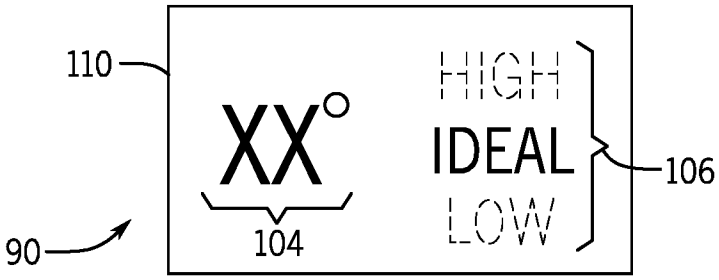
FIGS. 8-11C are side views of further embodiments of devices according to the present disclosure.

Further embodiments of visual indicators 100 include a digital display 110, such as that shown in FIG. 10. In this exemplary embodiment, the display 110 includes an incorporated angle sensor (not expressly shown), which is shown on the display. While not expressly discussed herein, angle sensors are known in the art, including those incorporated in modern smartphones or digital levels.

The display 110 of FIG. 10 further includes guidance output 106 to indicate to the user whether the angle α between the device 10 and the surface 4 is within the predetermined angle range. In the embodiment shown, this results in a guidance output 106 indicating whether the angle α, or more specifically the device 10, is "high," "low," or "ideal," meaning within the predetermined angle range.

Further embodiments of visual indicators 100 are also anticipated by the present disclosure, including the incorporation of colored lights 112 within the device 10. For example, the colored lights 112 may comprise three vertically-aligned LEDs that selectively illuminate depending upon whether the angle α between the device 10 and the surface 4 is high, ideal, or low. For example, the center LED would be illuminated to indicate that the device 10 is within the predetermined angle range, the top LED for too high, and the bottom LED for too low.

Further embodiments of angle indicators 90 are also anticipated, such an audible indicator 120 provided by speaker 122. While not expressly shown, one embodiment of an audible indicator 120 communicates with wireless headphones incorporated into ear protection worn by the operator. In this manner, audible guidance is given to the operator with respect to the angle α of the device 10. As previously discussed, each of the angle indicators 90 may further be configured to accommodate for differences between the surface 4 and the horizontal plane H, whereby the user may indicate to the angle indicator 90 when the work piece 2 is positioned such that the surface 4 is not parallel to the horizontal plane H.

Through experimentation and development, the present inventor has demonstrated that the presently disclosed devices 10 improved upon the performance of existing devices 6 known in the art. By way of non-limiting example, the device 10 was shown to perform well for removing corrosive layers from API-5L pipe, which is commonly used for transport of petroleum products in the on-shore and off-shore gas and oil industries. However, it should be recognized that the device 10 and others according to the present disclosure have utility for grinding, preparing, or otherwise working with work pieces across a wide variety of industries. Advantageously, these further include applications that typically require grit blasting, which is discussed further below.

The present inventor has identified that the use of pulleys, such as the driving pulley 30 and second pulley 40 shown in FIGS. 5-7B, has not previously been known or practiced in the art to create inertia-activated bristle belted rotary power tools. The embodiments and implementation of the presently disclosed devices 10 and methods accommodate numerous applications, including those within the field of surface preparation processes. Examples within surface preparation include, but are not limited to, corrosion removal, texture specification (also known as anchor profile), peening, work hardening, and other surface finishing applications. However, additional applications, both within and outside of surface preparation, are further anticipated by the present disclosure.

Currently, the only known existing device 6 relating to enhancing the motion and speed of bristle tips 64 prior to impact with the target surface 4 is that described by Patent Application EP1834733. However, the existing device 6 disclosed in Patent Application EP1834733 generates surfaces 4 that possess some of the negative features attributes of the grit blasting processes. That is, the harsh impact of the bristle tip 64 contacting the stop element 7 is immediately followed by rebound or retraction, which generates crater-like imperfections in surfaces 4 that emulate those generated by grit blasting processes.

Therefore, in addition to those previously described, the present inventor has identified several advantages of the presently disclosed device 10 over the existing devices 6 described in Patent Application EP1834733. First, the front or working end of the device 10 (nearest the second pulley 40) has a much smaller profile than existing devices 6 known in the art. This allows access into, and improves maneuverability within, narrow passageways. For example, this enables the presently disclosed device 10 to be used within the interior of pipe diameters that require surface preparation. Second, incorporating a belt 50 between the driving pulley 30 and second pulley 40, rather simply encircling a direct-driven hub 38 or shaft 36 coupled to the motor 20, allows for a substantially longer belt 50. In the embodiment of FIG. 7A, the belt 50 is approximately three times longer than those on hubs 38 or shafts 36 as known in the art. Therefore, it follows that the belt 50 life of the present device 10 would exceed belts 50 of the existing devices 6 by a factor of 3, avoiding costly change over time and additional inventory volume. Similarly, the absence of an "obstruction" or stop element 7 in the present device 10 extends the lives of both the bristles 60 and the belt 50, as well as the power of the pneumatic/electric motor by not be compromised or stressed with unnecessary repetitive contact. Moreover, the present device 10 provides a reduction in vibration and noise over existing devices 6 known in the art. Once again, this further benefits the life of the device 10, as well as both the safety and experience of the operator.

Figure 11A:
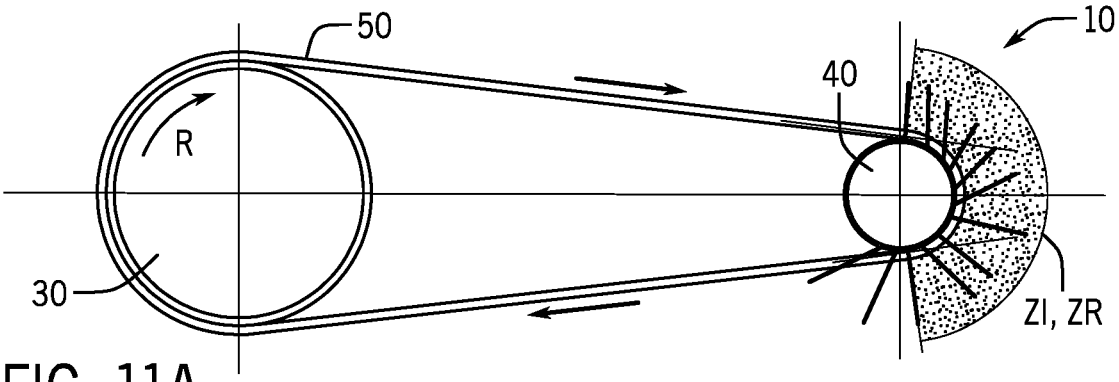
Figure 11B:
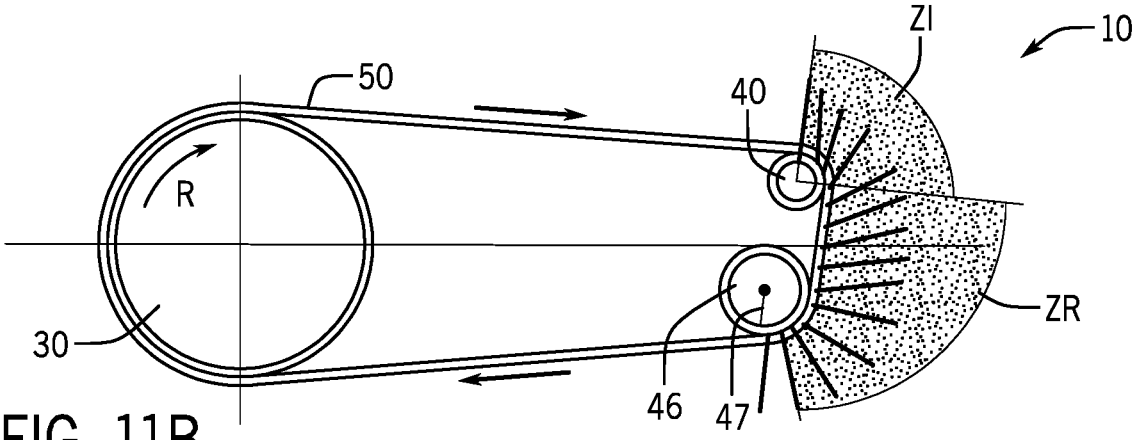
Figure 11C:
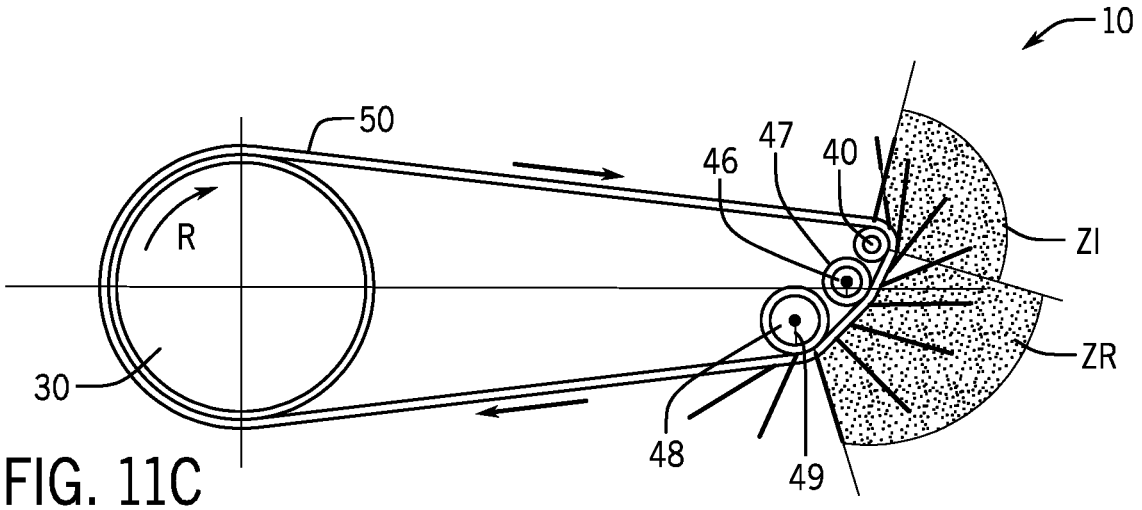

FIGS. 11A-11C demonstrate further embodiments of devices 10 according to the present application. As a basis for comparison, FIG. 11A depicts a device 10 similar to those previously shown in FIGS. 5-7B in which a belt 50 rotates about a driving pulley 30 and a second pulley 40. In this example, both the impulse and recovery phases (shown as impulse zone Z1 and recovery zone ZR) of the bristles 60 are defined by the second pulley 40. However, through experimentation and development, the present inventor has identified that the impulse and recovery profile can be further tuned through the introduction of additional pulleys.

In the embodiment shown in FIG. 11B, the belt 50 further passes around a third pulley 46 having a third radius 47. In the present case, the third radius 47 is larger than the second radius 42. Accordingly, the recovery zone ZR for the device 10 is greater when the third pulley 46 is incorporated, as compared to a device 10 having only the driving pulley 30 and second pulley 40. In this manner, the embodiment of FIG. 11A depicts a configuration in which the belt 50 is "tuned" to the device 10, whereas the embodiment of FIG. 11B depicts a device 10 that is tuned to the belt 50, providing configurability of the impulse and recovery of the bristles 60 in use.

Further tuning is provided by introducing additional pulleys, such as the fourth pulley 48 of fourth radius 49 incorporated into the embodiment of FIG. 11C. In this case, the additional pulleys following the second pulley 40 do not only create a step change in the recovery of the bristles 60, but provided for a graded or gradual recovery within the recovery zone ZR. In the present case, the radii increase as the belt 50 passes over the second pulley 40, third pulley 46, and fourth pulley 48 to provide a controlled, gradual recovery. However, it should be recognized that the present application anticipates any number of pulleys after the driving pulley 30 and second pulley 40 (including no additional), and any configuration of radii among the pulleys, in order to provide customization and optimal performance for matching the device 10 (including all pulleys therein), belt 50, bristles 60, and surface 2.

Certain embodiments of the device 10 further improve upon existing devices 6 by employing a greater width of the belt 50 (such as 42 mm vs. 21 mm), as well as an improved fiber-reinforced belt design, which further enhances the performance of the presently disclosed device 10.

As previously described, the present disclosure relates to multiple embodiments of devices 10 having a variety of applications. In one type of application, the presently disclosed devices 10 and methods relate to surface preparation in the community, such as within the context of the aging infrastructure that requires maintenance and refurbishment. Currently, the grit blasting process is the mainstay method used for cleaning and texturing surfaces prior to painting. However, grit blasting processes are difficult to implement due to environmental contamination and the need for specialized safety equipment that encapsulates the user during operation.

Consequently, the present applicant has identified that the presently disclosed device 10 serves as an indispensable method for "spot repair" applications—applications that involve local repair and local rehabilitation of surfaces that require immediate maintenance. As such, there is a great need for the present device 10 in many industries, including on-shore and off-shore gas and oil industries, civil infrastructure (bridges and railcar), and military and commercial ship building industries, for example.

By way of further example, another type of application for the presently disclosed devices 10 and methods relate to surface peening operations. Peening operations are carried out on metallic surfaces that are prone to fatigue failure and primary applications, such as those found in the aircraft industry and manufactured motor and/or machine components. In this case, the present inventor has identified the presently disclosed devices 10 and methods to be particularly advantageous when featuring polished hemispherical bristle tips 64 that impact the surface 4, without removing base metal.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other devices. It is to be expected that various equivalents, alternatives and modifications are possible within the scope of any appended claims.

I claim:

1. A device for processing a surface of a work piece, the device comprising:

a motor configured to produce a rotary force;

a driving pulley operatively coupled to the motor, wherein the rotary force produced by the motor causes rotation of the driving pulley;

a belt having an outer side and an inner side, wherein the inner side is operatively coupled to the driving pulley such that rotation of the driving pulley causes rotation of the belt;

a second pulley that is also operatively coupled to the inner side of the belt, wherein rotation of the belt causes rotation of the second pulley; and a plurality of bristles each having an anchor end and a bristle tip opposite the anchor end, wherein each anchor end is coupled to the belt, and wherein each bristle extends away from the belt;

wherein the driving pulley has a driving radius and the second pulley has a second radius, and wherein the driving radius is greater than the second radius;

wherein the rotary force produced by the motor causes the plurality of bristles to move relative to the motor; and wherein the surface of the work piece is processed when the bristle tip of a given bristle in the plurality of bristles contacts the surface while the given bristle is moving.

2. The device of claim 1, wherein the plurality of bristles extend outwardly from the outer side of the belt, and wherein the device further comprises a third pulley that is also operatively coupled to the inner side of the belt, wherein the rotation of the belt causes rotation of the third pulley.

3. The device of claim 1, wherein when processing the surface of the work piece the plurality of bristles contact only the belt and the surface of the work piece.

4. The device of claim 1, wherein the plurality of bristles are non-linear.

5. The device of claim 4, wherein the plurality of bristles move along a belt path, and wherein the bristle tip leads the anchor end for each of the plurality of bristles with respect to the belt path.

6. The device of claim 5, wherein the anchor end of each of the plurality of bristles extends perpendicularly from the belt when at rest.

7. The device of claim 1, further comprising a positioner foot, wherein a center line is defined between axes of the driving pulley and the second pulley, and wherein the positioner foot is configured to engage with the work piece such that the center line is maintained within a predetermined angle range relative to the surface.

8. The device of claim 7, wherein the predetermined angle range is 10-30 degrees.

9. The device of claim 1, further comprising a visual indicator, wherein a center line is defined between axes of the driving pulley and the secondary pulley, wherein the visual indicator shows an angle of the center line relative to a horizontal plane.

10. The device of claim 9, wherein the visual indicator further shows a predetermined angle range for the angle of the center line relative to the horizontal plane for positioning the device when processing the surface of the work piece.

11. The device of claim 10, wherein the visual indicator is a weighted level, and wherein the predetermined range is 10-30 degrees.

12. The device of claim 1, wherein when processing the surface of the work piece the second pulley is closer than the driving pulley to the surface.

13. The device of claim 1, wherein a center line is defined between axes of the driving pulley and the second pulley, wherein the belt follows a belt path having a plurality of positions during operation, wherein each position of the plurality of positions has a bristle tip speed during operation, and wherein the bristle tip speed is greatest at a maximum speed position in the plurality of positions, further comprising an indicator that indicates an angle between the work piece and the center line such that the bristle tip of a given bristle in the plurality of bristles contacts the surface when the given bristle is at the maximum speed position.

14. A method for processing a surface of a work piece, the method comprising:

producing a rotary force with a motor;

coupling a driving pulley to the motor such that the rotary force produced by the motor rotates the driving pulley;

coupling a belt to the driving pulley, wherein the belt has an outer side and an inner side, wherein the inner side is in contact with the driving pulley, and wherein rotating the driving pulley rotates the belt;

coupling a second pulley to the belt, wherein the driving pulley has a driving radius that is greater than a second radius of the second pulley, wherein the inner side is in contact with the second pulley, and wherein rotating the belt rotates the second pulley;

coupling a plurality of bristles to the belt, wherein each bristle in the plurality of bristles has an anchor end and a bristle tip opposite the anchor end, wherein each anchor end is coupled to the outer side of the belt, wherein each bristle in the plurality of bristles extends away from the belt, and rotating the belt causes the plurality of bristles to move relative to the motor; and processing the surface of the work piece by contacting the surface with the bristle tip of a given bristle in the plurality of bristles while the given bristle is moving.

15. The method of claim 14, wherein a center line is defined between axes of the driving pulley and the second pulley, wherein the belt follows a belt path having a plurality of positions during operation, wherein each position of the plurality of positions has a bristle tip speed during operation, and wherein the bristle tip speed is greatest at a maximum speed position in the plurality of positions, further comprising changing an angle between the surface of the work piece and the center line such that the bristle tip of a given bristle in the plurality of bristles contacts the surface when the given bristle is at the maximum speed position.

16. The method of claim 15, further comprising coupling a visual indictor to the device that shows an angle between the center line and a horizontal plane, wherein the visual indicator also shows a predetermined range of angles that corresponds to the maximum speed position occurring when the plurality of bristles contact the surface parallel to the horizontal plane.

17. The method of claim 16, wherein the predetermined range is 10-30 degrees.

18. The method of claim 16, wherein the plurality of bristles are non-linear, and wherein when processing the surface of the work piece the plurality of bristles contact only the belt and the surface of the work piece.

19. A device for processing a surface of a work piece, the device comprising:

a motor configured to produce a rotary force;

a driving pulley operatively coupled to the motor, wherein the rotary force produced by the motor causes rotation of the driving pulley;

a belt having an outer side and an inner side, wherein the inner side is operatively coupled to the driving pulley such that rotation of the driving pulley causes rotation of the belt;

a second pulley that is also operatively coupled to the inner side of the belt, wherein rotation of the belt causes rotation of the second pulley;

a third pulley that is also operatively coupled to the inner side of the belt, wherein rotation of the belt causes rotation of the third pulley; and a plurality of bristles each having an anchor end and a bristle tip opposite the anchor end, wherein each anchor end is coupled to the belt, and wherein each bristle extends away from the belt;

wherein the driving pulley has a driving radius, the second pulley has a second radius, and the third pulley has a third radius, and wherein the driving radius is greater than at least one of the second radius and the third radius;

wherein the rotary force produced by the motor causes the plurality of bristles to move relative to the motor; and wherein the surface of the work piece is processed when the bristle tip of a given bristle in the plurality of bristles contacts the surface while the given bristle is moving.

20. The device according to claim 19, wherein the belt rotates from the driving pulley to the second pulley to the third pulley, and wherein the third radius is smaller than the first radius and larger than the second radius.

* * * * *